US008133093B2

(12) United States Patent
Vogtmann et al.

(10) Patent No.: US 8,133,093 B2
(45) Date of Patent: Mar. 13, 2012

(54) GRINDING APPARATUS HAVING AN EXTENDABLE WHEEL MOUNT

(75) Inventors: Michael Vogtmann, Paso Robles, CA (US); Thomas A. Walsh, Atascadero, CA (US)

(73) Assignee: Strasbaugh, Inc., San Luis Obispo, CA (US)

( * ) Notice: Subject to any disclaimer, the term of this patent is extended or adjusted under 35 U.S.C. 154(b) by 729 days.

(21) Appl. No.: 12/287,550

(22) Filed: Oct. 10, 2008

(65) Prior Publication Data

US 2010/0093264 A1 Apr. 15, 2010

(51) Int. Cl.
*B24B 49/00* (2012.01)
*B24B 7/00* (2006.01)

(52) U.S. Cl. ..... 451/11; 451/65; 451/259

(58) Field of Classification Search ..... 451/11, 451/65, 398, 397, 10, 8, 259, 285–289, 390, 451/273, 276
See application file for complete search history.

(56) References Cited

U.S. PATENT DOCUMENTS

| | | | | |
|---|---|---|---|---|
| 3,885,925 | A * | 5/1975 | Tatar | 451/48 |
| 6,179,695 | B1 * | 1/2001 | Takahashi et al. | 451/287 |
| 6,277,002 | B1 * | 8/2001 | Leadbeater | 451/57 |
| 6,336,849 | B1 * | 1/2002 | Konnemann | 451/259 |
| 6,386,956 | B1 * | 5/2002 | Sato et al. | 451/57 |
| 7,014,540 | B2 * | 3/2006 | Nagel | 451/57 |
| 7,118,446 | B2 * | 10/2006 | Walsh et al. | 451/5 |

* cited by examiner

*Primary Examiner* — Dung V Nguyen
(74) *Attorney, Agent, or Firm* — Irving Keschner

(57) ABSTRACT

A grinding machine wherein coarse and fine grind wheels are mounted to a single rotating spindle. A multiple grind wheel mount is attached to the lower portion of the rotating spindle, the coarse and fine wheels being supported by the wheel mount, the wheel mount containing the mechanism for moving the inner coarse wheel down relative to the stationary outer fine wheel.

12 Claims, 6 Drawing Sheets

GRINDING APPARATUS HAVING AN EXTENDABLE WHEEL MOUNT

BACKGROUND OF THE INVENTION

1. Field of the Invention

The present invention provides a grinding machine wherein the coarse and fine grinding wheels are driven by a single rotating spindle, a wheel mount attached to the lower portion of the spindle containing the mechanism for moving the inner coarse wheel down to the workpiece relative to the stationary outer fine wheel.

2. Description of the Prior Art

U.S. Pat. No. 7,118,446, assigned to the assignee of the present invention, discloses a grinding assembly for shaping work pieces that includes one or more grind spindles, each of the grind spindles including two independent grinding wheels driven by the same spindle drive. The grind spindles translate horizontally to perform both edge and face grinding with a single grind spindle. A non-contact position sensor in a work spindle measures work spindle displacement during grinding and provides feedback to the grind spindle to regulate the force imparted on the work piece by the grind spindle.

The double spindle air bearing utilized in the '446 system mounts a stationary outer support structure, rotating spindle, and an inner concentric shaft. The rotating spindle is supported (inside) by the stationary outer support. The rotating spindle has an inner concentric shaft which is rotationally keyed to the spindle, but is allowed to move up and down. The up/down actuation is contained in the upper section of the rotating spindle/support structure. The fine grinding wheel is attached to the lower portion of the rotating spindle, and the coarse wheel is attached to the lower portion of the inner concentric shaft. The fine and coarse wheels rotate together since the inner concentric shaft and the spindle are keyed together rotationally. In the retract position, the coarse wheel is retracted up so the fine wheel can be used for grinding. In the extend position, the coarse wheel is extended out beyond the fine wheel so the coarse wheel can be used for grinding. The actuation of the inner coarse wheel is done by the inner concentric shaft of the spindle assembly. The cost of the spindle air bearing has increased dramatically and has prompted a design that is lower in cost and can be utilized in most grinder machines to increase throughput in a dual grind application (coarse and fine).

SUMMARY OF THE INVENTION

The present invention provides a device for use in a precision grind wheel bearing assembly wherein the fine and coarse wheel actuation and support member is located in a wheel mount assembly instead of the inner concentric shaft of the spindle assembly.

The device of the present invention comprises a coupler/spline shaft assembly having a top coupler, a rotating spindle shaft, middle coupler and bottom coupler attached to the lower portion of the rotating spindle. When the spindle shaft rotates, the fine wheel mount rotates causing the above noted components to rotate. The middle coupler is assembled between the top coupler and the bottom coupler. Indentations on the inside diameter of the middle coupler and the outside diameter of the spline shaft create a spline interface, which prevents the middle coupler from rotating relative to the spline shaft but allows for vertical movement. Springs between the middle coupler and the bottom coupler preload the middle coupler in the retract position, the middle coupler pushing against the top coupler engaging the two mating face gears. The couplers face gears are made with the same diameter, same number of teeth, and have equal tooth geometry. Due to the number of contact points during the interface of the two face gears, the contact stresses are minimized enabling torque to be transmitted. When the coarse wheel is actuated the middle coupler moves down to interface with the bottom coupler. The interfacing face gears of the coupling provide a repeatable and stiff connection. The spline shaft and the bottom coupler are vertically stationary components mounted to the fine wheel mount.

In the retract position, the coarse wheel is recessed in the wheel mount assembly allowing the fine wheel to be used for grinding. The retract position is the standard position of the wheel mount (no actuation). The springs of the coupler assembly push up the middle coupler to engage the top coupler. The face gear pair provides a repeatable and stiff interface. The middle coupler provides the mounting/support for the coarse wheel mount. In the retract position, the top coupler provides rigid positioning and enables the assembly to be balanced which is critical for high speed quality grinding surfaces (i.e. 5000 rpm).

Actuation (i.e. to move coarse wheel into position for grinding work piece) is preferably provided by pressurized fluid (air or water) although other methods can be used, such as a push bar, linear motor, ball screw, etc. Pressurized fluid enters the center of the wheel mount through the hollow spindle shaft. Since the center portion of the wheel mount is sealed with a rolling diaphragm, pressure builds up creating a force which pushes down the diaphragm guide. The diaphragm guide causes the bottom shield, coarse wheel mount, coarse wheel, and middle coupler to move down, the middle coupler moving downward until it engages the bottom coupler. In the extend position, the bottom coupler transmits the torque to the coarse wheel assembly (middle coupler, coarse wheel mount, coarse wheel). In one embodiment, a pressure sensor monitors the fluid pressure to determine if the assembly is in the extend (positive pressure)/retract (no pressure) position. When the fluid pressure is relieved the wheel mount returns to its retract position by spring force.

The extended wheel mount assembly of the present invention can be utilized with any grinding apparatus (such as the apparatus disclosed in the '446 patent) by attaching it via bolts to the grind spindle (typically an upper air bearing spindle). In this case, an adapter plate is provided to enable the wheel mount assembly to be physically mounted to the lower portion of the grind spindle. The spindle requires a hole through its center to allow fluid (or a push bar, for example,) to actuate the assembly. The same principle would apply to other grinding apparatus.

The present invention thus provides a wheel mounting assembly mounted to the lower portion of the grinding spindle, the inner wheel actuation mechanism being mounted therein, this feature eliminating the need to purchase a grinding apparatus having the inner coarse wheel activated by the spindle, thus simplifying and reducing the overall cost of the grinding apparatus.

It should be noted that the extendable wheel mount assembly of the present invention is not limited to using two grind wheels (coarse and fine). In particular, the assembly may incorporate several nested components such as (from smallest to largest) an edge grinding tool, a coarse grind wheel, a fine grind wheel and a stress relief polish ring.

DESCRIPTION OF THE DRAWINGS

For a better understanding of the present invention as well as other objects and further features thereof, reference is made to the following description which is to be read in conjunction with the accompanying drawing wherein.

DESCRIPTION OF THE INVENTION

Figure 1:
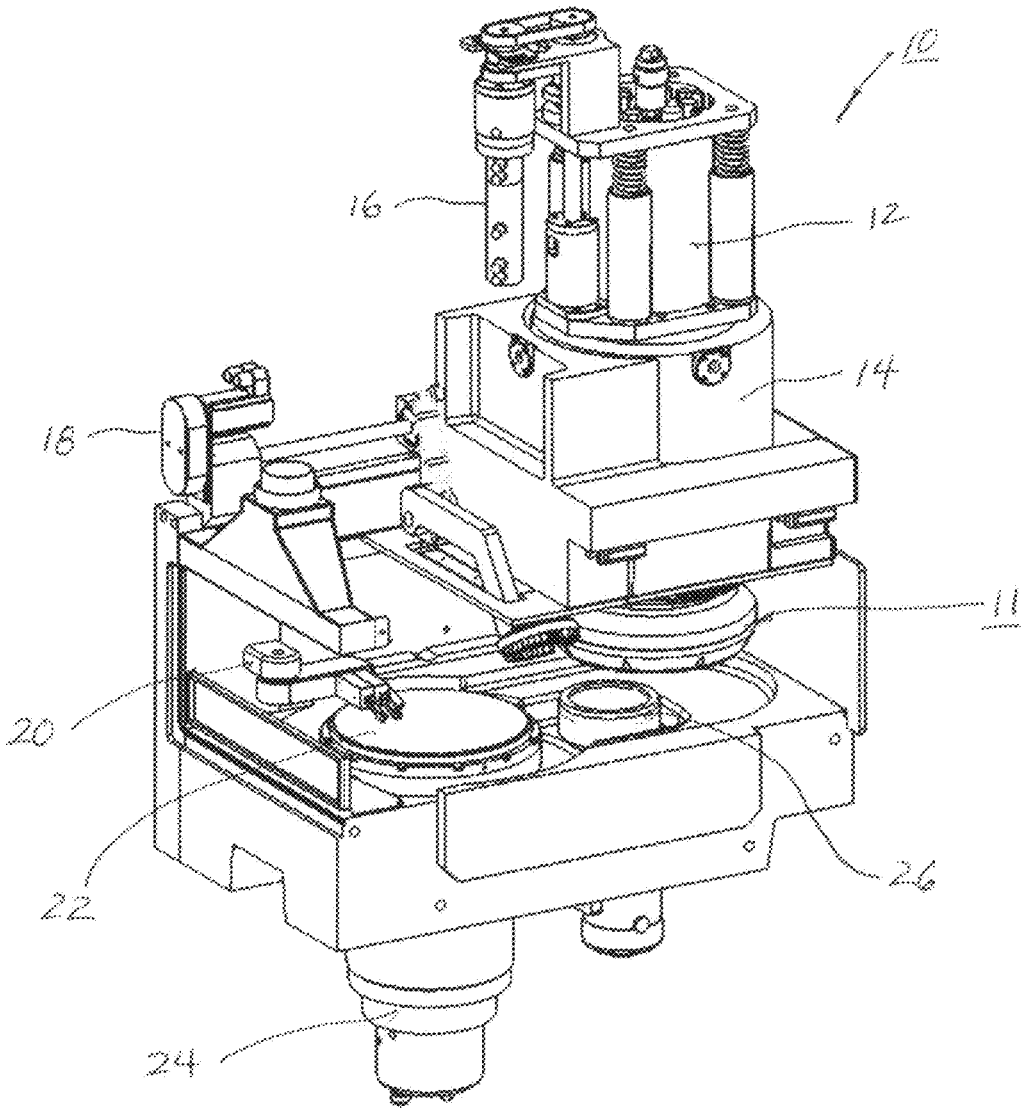
FIG. 1 is a perspective view of a grinding apparatus utilizing the wheel mount of the present invention.

FIG. 1 is a perspective view of a grinding apparatus 10 which is adapted to use the extendable wheel mount assembly 11 of the present invention (the basic operation of apparatus 10 is shown in the '446 patent and will not be disclosed herein for the purposes of brevity; the teachings of the patent necessary for the understanding of the present invention being incorporated herein by reference).

Apparatus 10 comprises grind spindle 12, air bearing linear guide 14, Zaxis force responsive servomechanism 16, y-axis servomechanism 18, thickness measurement sensor 20, vacuum workchuck 22, lower work spindle (with integrated force sensor) 24 and automatic wheel dressing 26.

Figure 2:
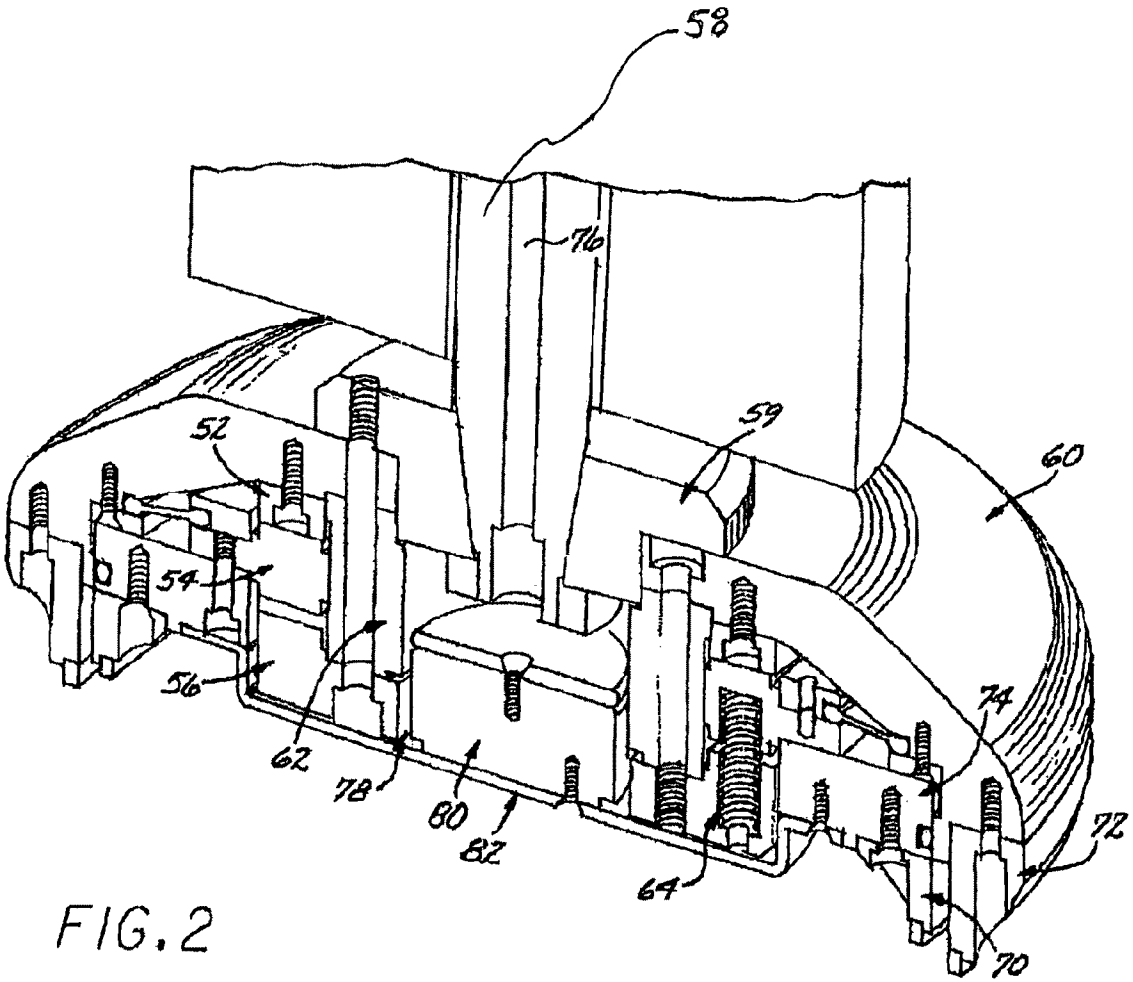
FIG. 2 is a cross-sectional view along line 2-2 of FIG. 1 showing the wheel mount in the retracted position.
Figure 3A:
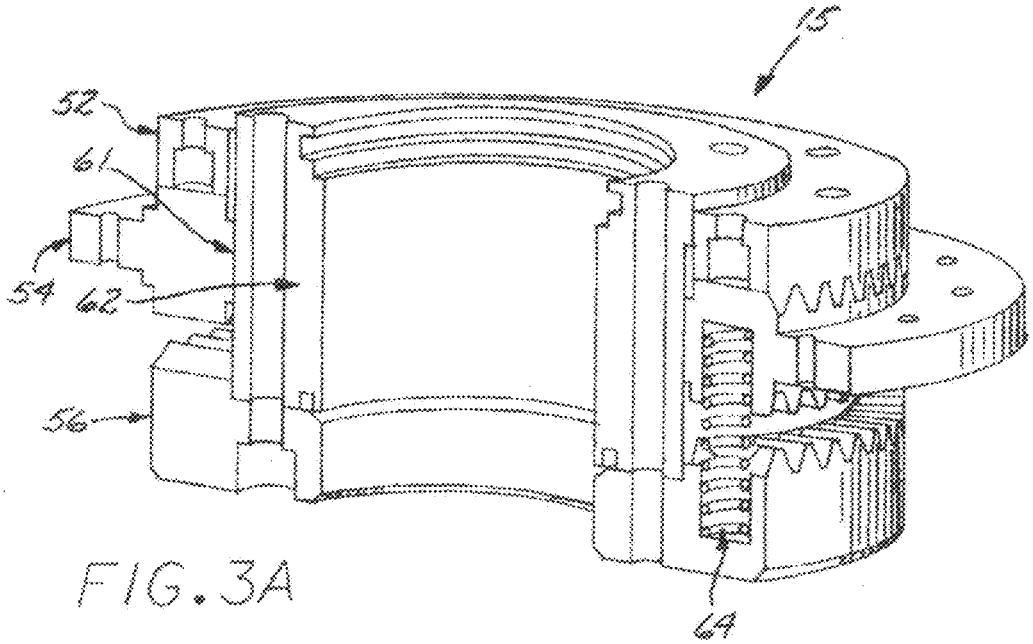
FIG. 3A illustrates the wheel mount in the retract position and FIG. 3B illustrates the wheel mount in the extend position, both figures illustrating the coupler/spline assembly.
Figure 3B:
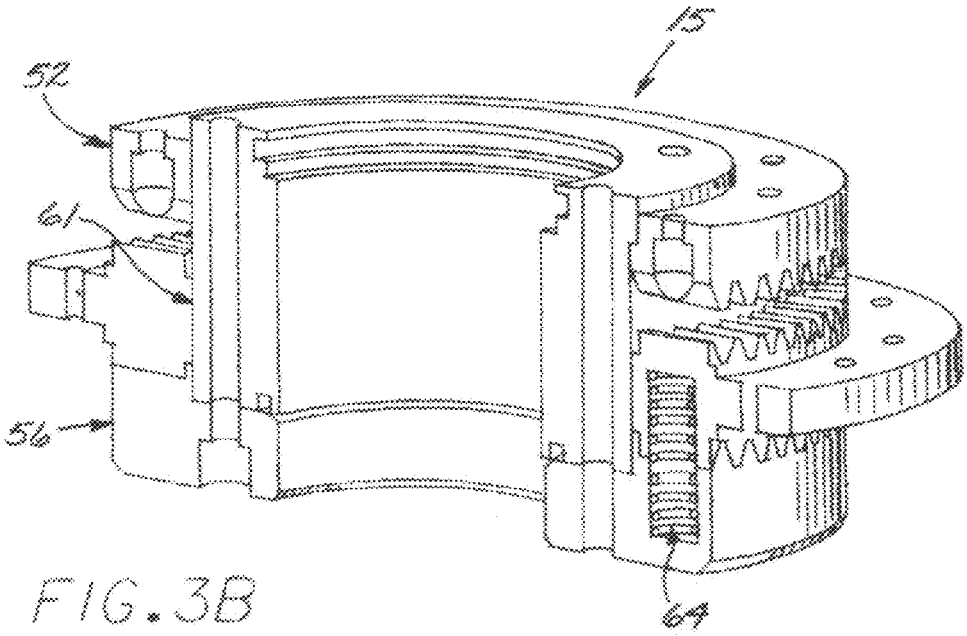
Figure 4:
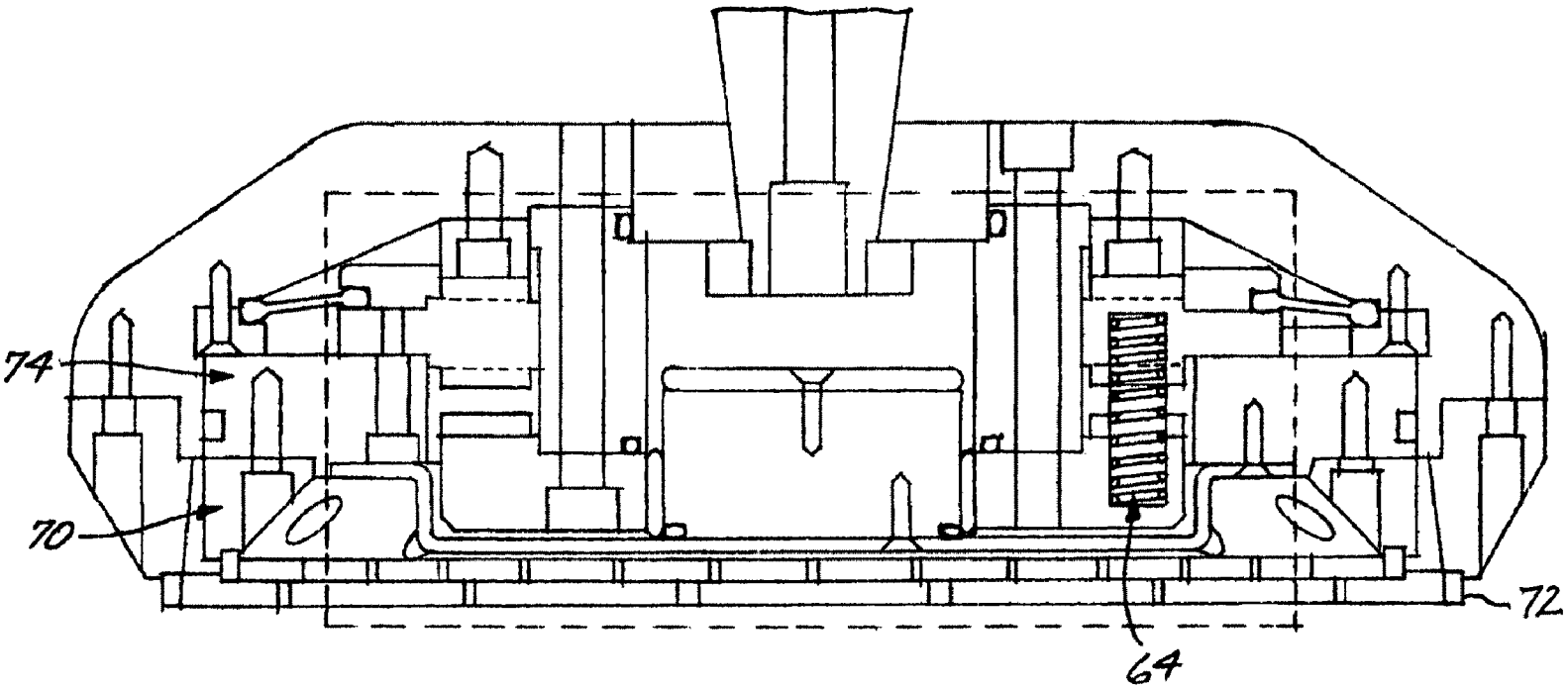
FIG. 4 illustrates the wheel mount assembly in the retract position.
Figure 5:
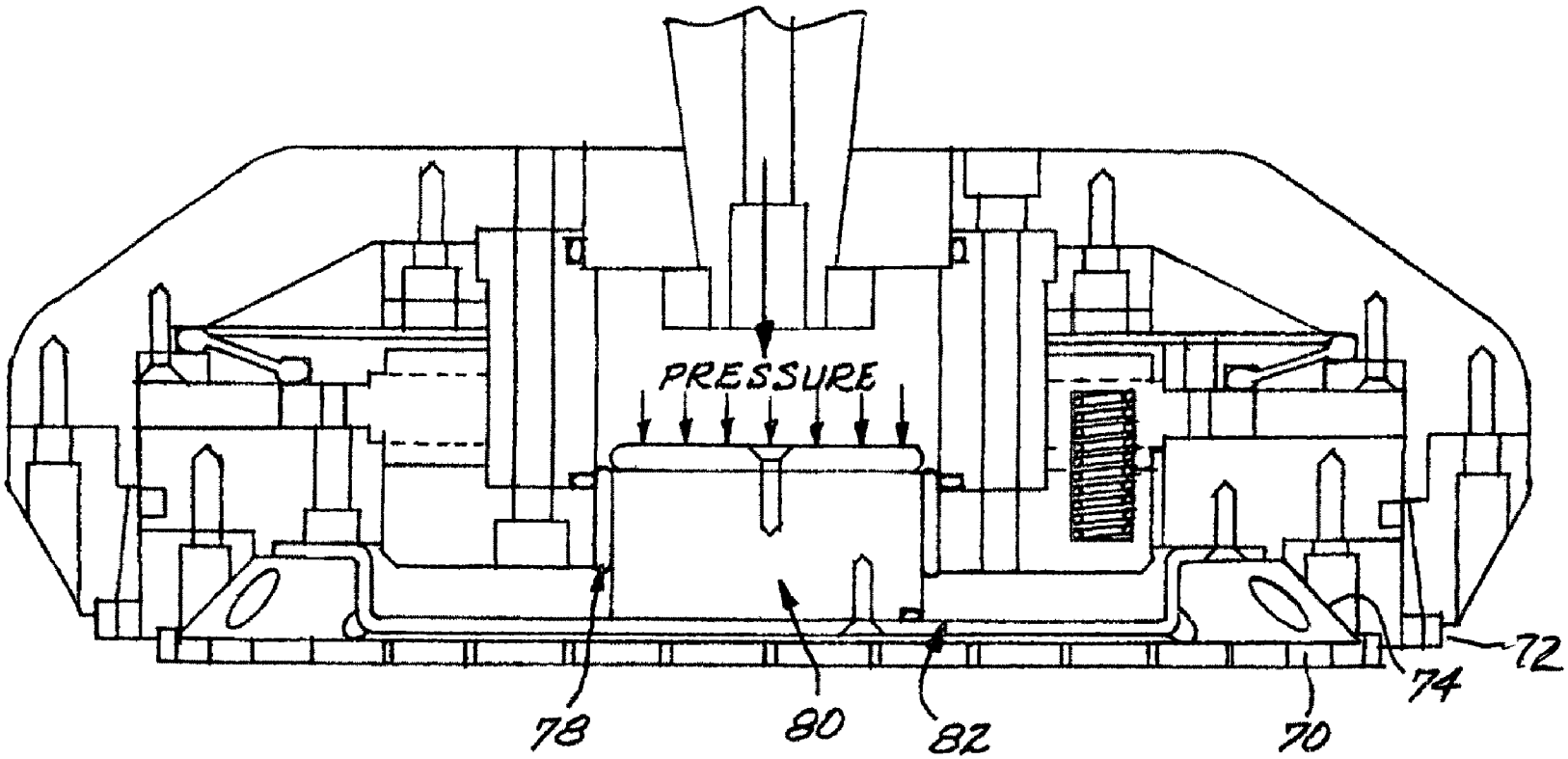
FIG. 5 illustrates actuation of the coarse grind wheel.

Referring to FIG. 2, 3 and 4, the coupler/spline assembly 15 is made up of four components; top coupler 52, middle coupler 54; spline shaft 62 and bottom coupler 56, the last two components being vertically stationary components mounted to fine wheel mount 60. An adapter plate 59 enables the assembly 11 to be mounted to spindle shaft 58 (a number of companies have the capability of manufacturing the type of couplers noted hereinabove). When the spindle shaft 58 rotates, the fine wheel mount 60 rotates causing the components noted above to rotate. The middle coupler 54 is assembled between the top coupler 52 and the bottom coupler 56. The inside diameter of the middle coupler 54 and the outside diameter of spline shaft 62 create a spline interface 61 which prevents the middle coupler 54 from rotating relative to the spline shaft 62 but allowing for vertical movement. Four springs 64 (only one shown) are used between the middle coupler 54 and bottom coupler 56 to preload the middle coupler 54 to the retract position. In this position, the middle coupler 54 is pushed against the top coupler 52, thus engaging two mating face gears. The couplers face gears are made with the same diameter, the same number of teeth, and have equal tooth geometry. The individual tooth geometry variations are averaged out over all the teeth resulting in good repeatability. Due to the high number of contact points during the interface of the two face gears, the contact stresses are low thus enabling torque to be transmitted. When coarse wheel 70 is actuated, the middle coupler 54 moves down to interface with bottom coupler 56. The interfacing face gears of the coupling provide a repeatable and stiff connection and transmit the grinding torque and down force during coarse wheel grinding.

In the retract position, the coarse wheel 70 is recessed in the wheel mount assembly allowing the fine wheel 72 to be used for grinding. The retract position is the standard position of the wheel mount assembly 11 when the system is not actuated. Spring 64 of the coupler assembly 11 forces the middle coupler 54 upwards to engage the top coupler 52. The face gear pair (middle coupler 54 and top coupler 52) provides a repeatable and stiff interface. The middle coupler 54 provides the mounting/support for coarse wheel mount 74. The coarse wheel mount 74, in turn, provides the mounting/support for coarse wheel 70. In the retract position, the top coupler 52 holds the coarse wheel assembly (middle coupler 54, coarse wheel 70 and coarse wheel mount 74) firmly in place and keeps the assembly in balance.

The preferred actuating mechanism for actuating the coarse grinding system is pressurized fluid (air or water) although other actuation methods can be used (such as a push bar). Pressurized fluid enters the center of the wheel mount assembly 11 through the spindle shaft 76. Since the center portion of the wheel mount assembly 11 is sealed with rolling diaphragm 78, the pressure buildup creates a force which pushes down diaphragm guide 80. Diaphragm guide 80 causes bottom shield 82, coarse wheel mount 74, coarse wheel 70, and middle coupler 54 to move in the downward direction. The middle coupler 54 moves down until it engages the bottom coupler 56, the face gear of couplers 54 and 56 providing a repeatable and stiff interface. In the extend position, bottom coupler 56 transmits the torque to the coarse wheel assembly (middle coupler 54, coarse wheel mount 74, coarse wheel 70). A pressure sensor is used to monitor the fluid pressure to determine if the assembly is in the extend (positive pressure)/retract (no pressure) position. When the fluid pressure is removed, the wheel mount assembly 11 returns to its retract position.

Figure 6:
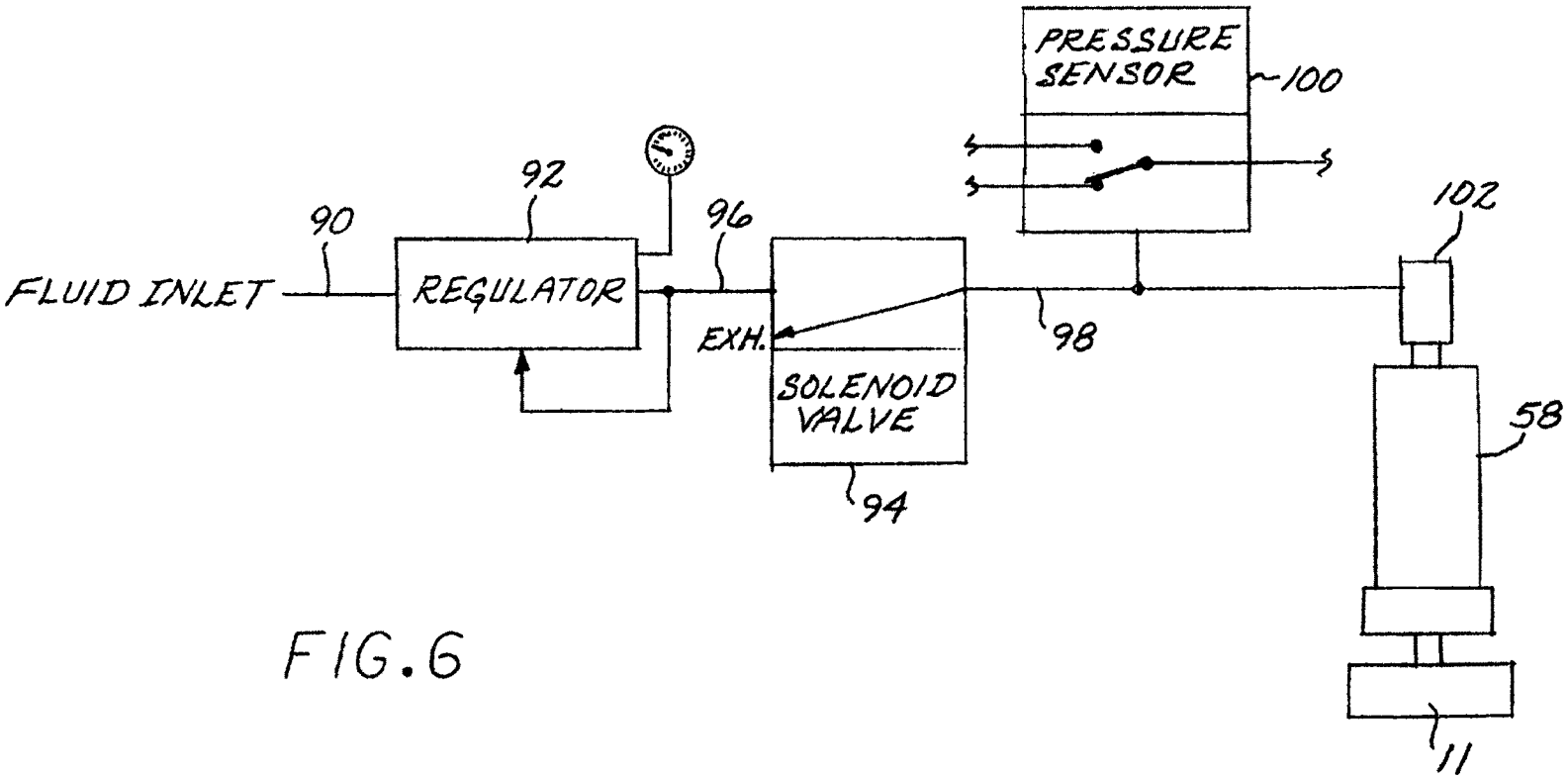
FIG. 6 illustrates a fluid interconnect diagram.

FIG. 6 is a simplified system fluid interconnect diagram. Actuating fluid (air) is forced into grinding apparatus 10 via inlet 90 by an air compressor (not shown) extending coarse grinding wheel 70. The fluid from regulator 92 is directed to solenoid valve 94 via tubing 96. Machine software (not part of the present invention) controls the state (on/off) of the solenoid valve 94 via tubing 96. Rotary union 102 conducts the fluid from solenoid valve 94 via tubing 98 to the air bearing spindle 58 and is designed to withstand high levels of heat and pressure. Sensor 100 is positioned between solenoid valve 94 and the rotary union 102. If sensor 100 detects fluid pressure below a predetermined value, then solenoid valve 94 is in the "off" state allowing the system 10 to be in the retracted position. If the sensor detects pressure above the predetermined value, then solenoid valve 94 is in the "on" state forcing the system 10 to be in the extended position.

The shape of adapter plate that mounts the extendable wheel mount assembly to the upper spindle assembly will vary depending upon the upper spindle mating pilot feature and mounting home pattern in the grind apparatus provided by manufacturers of such apparatus.

The present invention thus provides a compact grinding apparatus wherein the expense thereof is substantially reduced by utilizing an extendable wheel mount device attached to the grinding spindle, the wheel mount incorporating the coarse wheel actuating mechanism.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A grinding apparatus comprising a first spindle having a vertical axis, first and second grinding wheels axially disposed and configured to rotate about the axis with the first grinding wheel positioned adjacent said second grinding wheel, said first grinding wheel axially movable relative to the second grinding wheel, said first and second grinding wheels being supported in a wheel mount member coupled to said grind spindle, an actuating mechanism located within said wheel mount member for actuating said first grinding wheel, whereby said first grinding wheel is enabled to move vertically with respect to said second grinding wheel, said actuating mechanism comprising first, second and third coupler members and a mount for said first grinding wheel.

2. The grinding apparatus of claim 1 wherein said first and third couplers are stationary and mounted to said second wheel mount.

3. The grinding apparatus of claim 2 wherein rotation of said spindle shaft causes said first wheel mount to rotate.

4. The grinding apparatus of claim 3 wherein said second coupler is positioned between said first and third couplers, said second coupler interfacing with said spline shaft which prevents said second coupler from rotating with respect to said spline shaft.

5. The grinding apparatus of claim 4 further including spring members positioned between said second and third couplers to maintain said second coupler in the retract position when said actuating mechanism is in the inoperative state.

6. The grinding apparatus of claim 5 wherein in said first position a first surface of said first coupler engages a first surface of said second coupler.

7. The grinding apparatus of claim 6 wherein said actuating mechanism causes said second coupler to move downward along said vertical axis and engage said third coupler.

8. The grinding apparatus of claim 5 wherein an actuation fluid is introduced to said flange member through said spindle shaft, the fluid pressure creating a force which pushes the guide member.

9. The grinding apparatus of claim 8 wherein the guide member causes said shield member, said first wheel mount, said first wheel and said second coupler to move vertically downward.

10. The grinding apparatus of claim 9 wherein said second coupler engages said third coupler, the third coupler transmitting torque to said first wheel.

11. The grinding apparatus of claim 8 further including a sensor to monitor said fluid pressure, a positive pressure indicating that said first wheel is in the extend position, a lack of pressure indicating that said first wheel is in the retract position.

12. The grinding apparatus of claim 11 wherein a lack of pressure detected during the grind process causing said first wheel to return to the retract position.

* * * * *